US010210691B1

(12) United States Patent
Lantz et al.

(10) Patent No.: US 10,210,691 B1
(45) Date of Patent: Feb. 19, 2019

(54) LOCKING BALLOT DEPOSITORY WITH BAFFLE

(71) Applicant: A. Rifkin Co., Hanover Township, PA (US)

(72) Inventors: Paul D. Lantz, Kingston, PA (US); Donald R. Casterline, Mountain Top, PA (US)

(73) Assignee: A. Rifkin Co., Hanover Township, PA (US)

( * ) Notice: Subject to any disclaimer, the term of this patent is extended or adjusted under 35 U.S.C. 154(b) by 0 days.

(21) Appl. No.: 16/058,584

(22) Filed: Aug. 8, 2018

(51) Int. Cl.
*G07C 13/02* (2006.01)

(52) U.S. Cl.
CPC ..... *G07C 13/02* (2013.01)

(58) Field of Classification Search
CPC ..... G07C 13/02; A45C 3/00; B65D 43/12; B65D 47/286
USPC ..... 232/2, 44, 1 D; 206/807; 220/214, 253, 220/254.9, 259.5, 345.1, 345.2; 383/42, 383/66
See application file for complete search history.

(56) References Cited

U.S. PATENT DOCUMENTS 154,148 A * 8/1874 Omensetter et al. .. G07C 13/02 232/2
911,286 A * 2/1909 Bennan ..... G07C 13/02 232/2
1,275,579 A * 8/1918 McGowan ..... G07C 13/02 232/2
1,545,435 A * 7/1925 McFarland ..... G07C 13/02 190/111
1,673,769 A * 6/1928 Graham ..... G07C 13/02 220/6
1,821,710 A * 9/1931 Holbert ..... G07C 13/02 232/2
2,437,584 A * 3/1948 Zamora ..... G07C 13/02 232/2
2,649,244 A * 8/1953 Miller ..... G07C 13/02 232/2
5,681,113 A * 10/1997 Rifkin ..... A45C 3/00 232/2
7,395,956 B1 * 7/2008 Bell ..... G07C 13/02 220/4.33
8,245,905 B2 * 8/2012 Lantz ..... G07C 13/02 206/807
2009/0206150 A1 * 8/2009 Lantz ..... G07C 13/02 232/2

* cited by examiner

*Primary Examiner* — William L Miller
(74) *Attorney, Agent, or Firm* — Mitchell A. Smolow

(57) ABSTRACT

A ballot depository is provided having a baffle which includes a base frame engaging member, a stabilizing member, and a slot obstructing member. In a preferred form, the stabilizing member is supported by at least one of a slot guide, a base frame guide, or a trough, preferably supported by two of the three, and most preferably supported by all three.

20 Claims, 10 Drawing Sheets

FIG. 3A
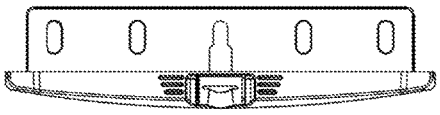
FIG. 3E
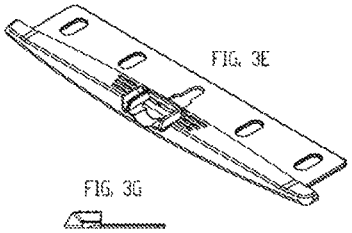
FIG. 3C
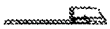
FIG. 3B
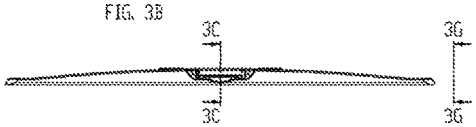
FIG. 3G
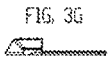
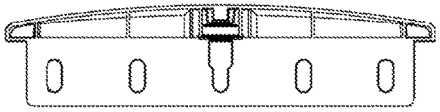
FIG. 3D
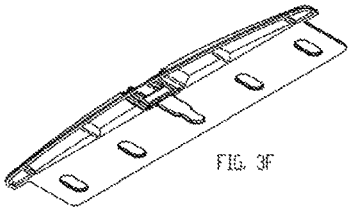
FIG. 3F FIG. 4A
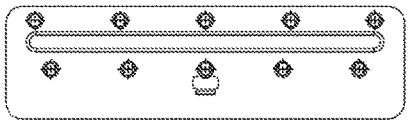
FIG. 4F
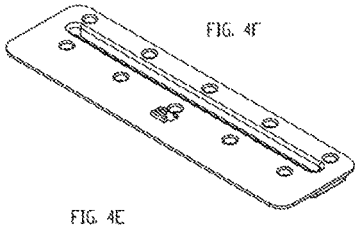
FIG. 4C
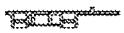
FIG. 4B
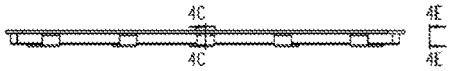
FIG. 4E
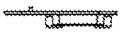
FIG. 4G
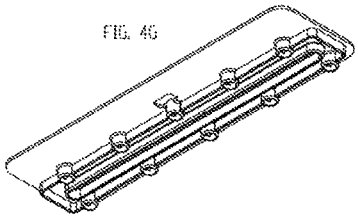
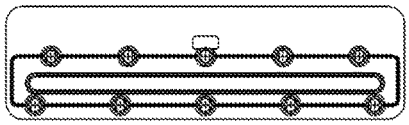
FIG. 4D FIG. 5A
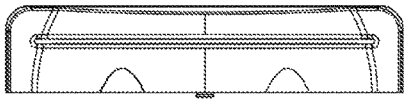
FIG. 5G
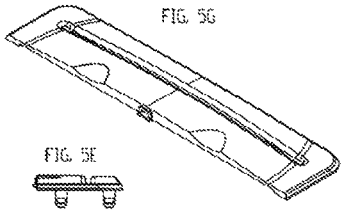
FIG. 5D
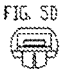
FIG. 5C
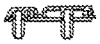
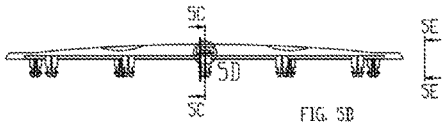
FIG. 5B
FIG. 5E
FIG. 5H
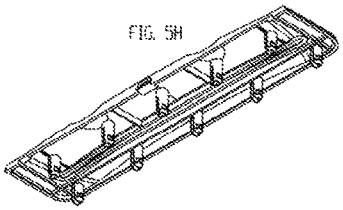
FIG. 5F
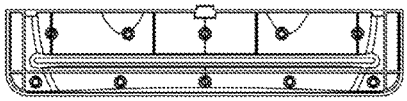

LOCKING BALLOT DEPOSITORY WITH BAFFLE

FIELD OF THE INVENTION

This invention relates generally to ballot receptacles and in particular, to baffled ballot receptacles.

BACKGROUND OF THE INVENTION

A ballot is typically a paper sheet or card used to cast or register a vote, usually a secret one. While a receptacle may be adapted to receive and store ballots it is also useable as a depository for materials other than ballots, for example, sheets or cards, completed survey forms, other forms that must be collected, or any sort of identification or token used as a marker for making a choice.

A conventional ballot box receptacle may be made of, for example, metal, wood, plastic, or fabric and is provided with a locked hinged cover having an entry slot to receive ballots. One problem with a conventional ballot box is that it is possible to shake out the deposited ballots through the entry slot.

Efforts have been made to prevent such tampering. For example, in one form a ballot box has a slotted, locked hinged cover and a closure mounted on the underside of the entry slot. The closure takes the form of a pivoted plate that is weighted at one end so that the plate normally lies against the slot and is swung open only by a ballot inserted in the slot. A deposited ballot cannot be shaken out of the box because the entry slot is blocked by the plate.

One preferred form of a ballot depository is a ballot bag or pouch fabricated from, for example, leather, fabric or other flexible material. These bags are more easily carried and transported to and from a polling place than a rigid ballot box. In one known form, a ballot bag comprises a flexible material which has a rigid cover disc provided with an entry slot. To prevent tampering with the pouch a spring-biased, hinged flap is mounted below the entry slot so that the flap is swung open by an inserted ballot. Once a ballot is deposited the slot is then blocked by the closed flap preventing the ballot from being withdrawn through the entry slot. Of course, use of spring-biased hinged flap increases the difficulty of inserting a paper ballot into the receptacle.

Accordingly, there is still a continuing need for improved ballot depository designs. The present invention fulfills this need and further provides related advantages.

BRIEF SUMMARY OF THE INVENTION

In a preferred embodiment a ballot depository is provided having a slot with a baffle comprising a base frame engaging member, a stabilizing member, and a slot obstructing member. In a preferred form, the stabilizing member is supported by at least one of a slot guide, a base frame guide, or a trough, preferably supported by two of the three, and most preferably supported by all three.

An object of the invention is to provide a baffled voting slot that prohibits tampering with contained ballots.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIGS. 3A-G, 4A-G, and 5A-H depict further embodiments and views of the device described below with reference to FIGS. 1 and 2.

DETAILED DESCRIPTION OF THE INVENTION

Figure 1A:
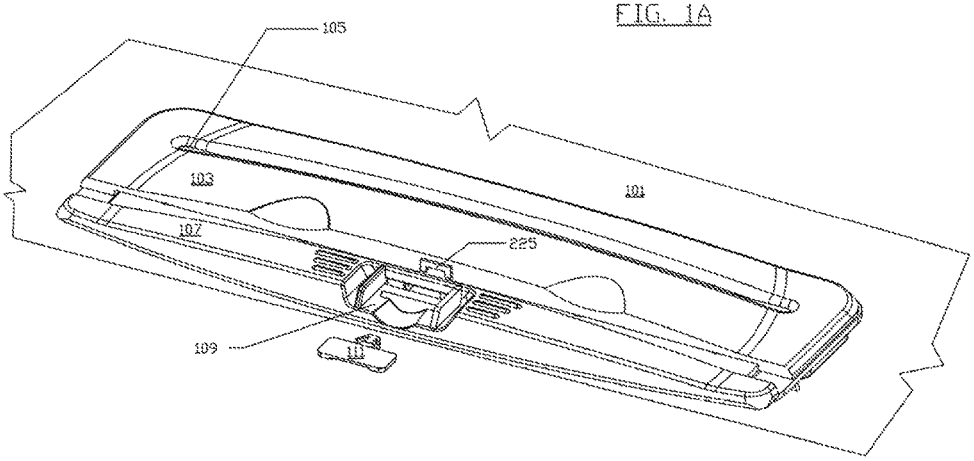
FIG. 1A is a perspective view of a baffled slot in an unlocked position

As required, detailed embodiments of the present invention are disclosed; however, it is to be understood that the disclosed embodiments are merely exemplary of the invention that may be embodied in various forms. The figures are not necessarily to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

While described with respect to a ballot bag, it should be appreciated that the baffled geometry described below can be used to secure a slot in any structure, including, for example, a box, wall, or floor.

Figure 1B:
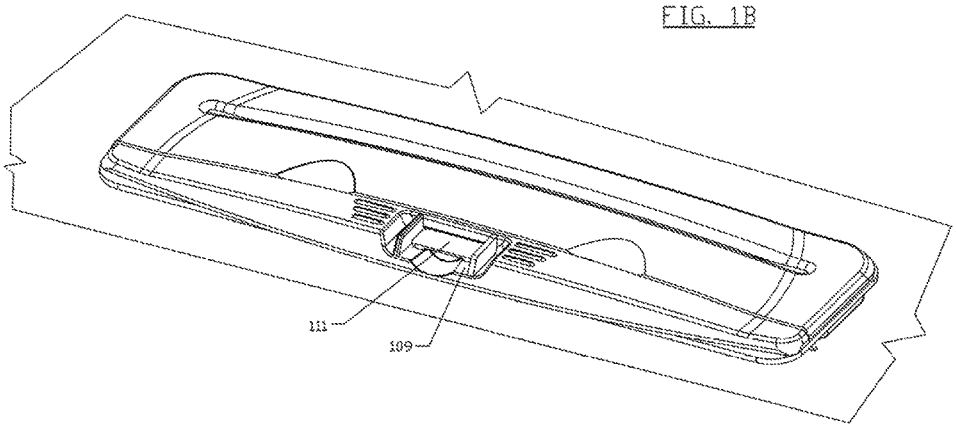
FIG. 1B is a perspective view of a baffled slot in a locked position.
Figure 2:
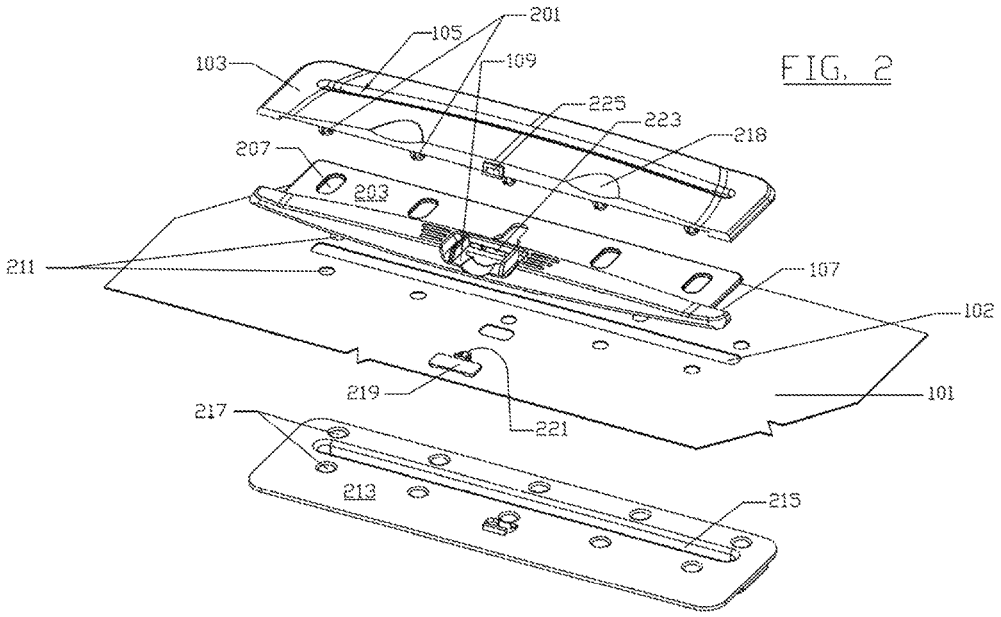
FIG. 2 is an exploded perspective view of the device depicted in FIGS. 1A and 1B.
Figure 6:
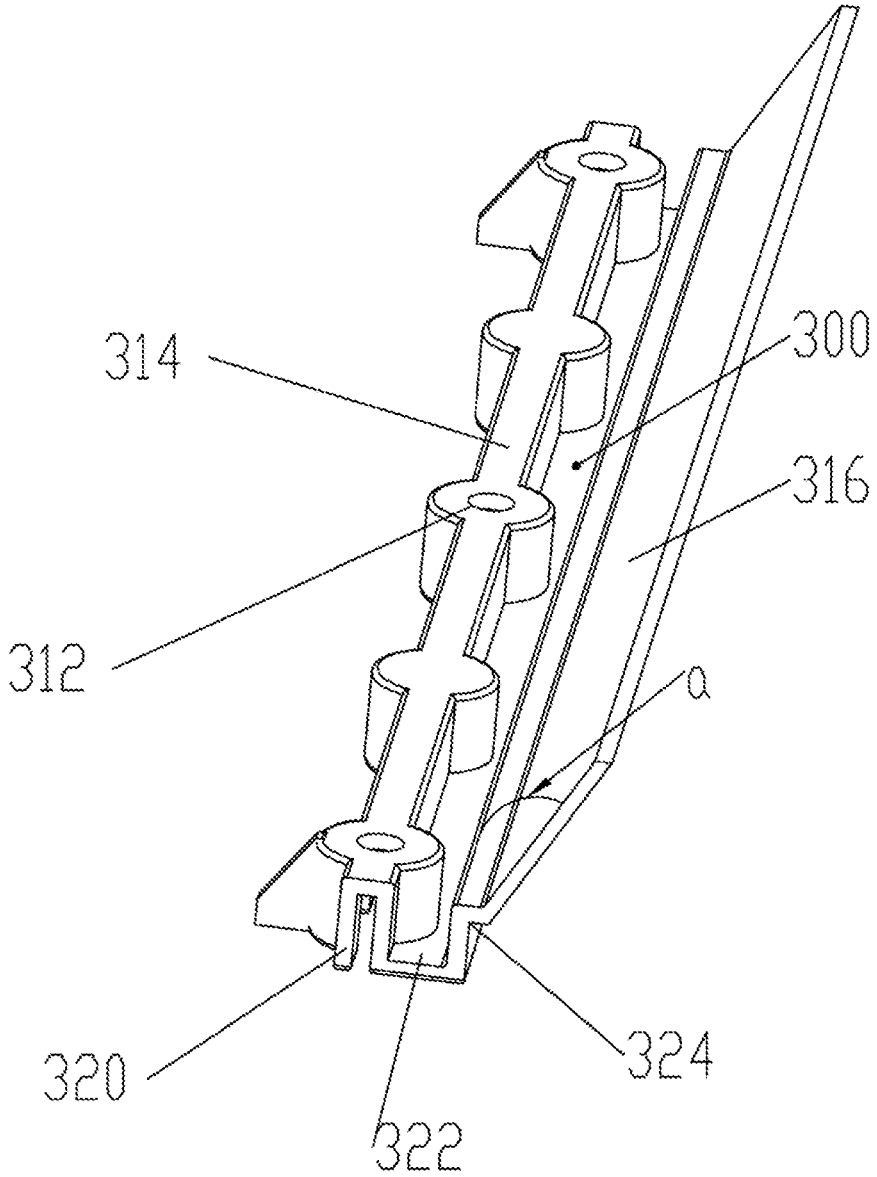
FIG. 6 is a perspective view of a baffle.

Turning to FIGS. 1A, 1B and 2, a flexible bag or pouch 101, typically made of leather or synthetic fiber or sheet, is provided with a bag opening 102. Disposed over the bag opening 102 is a frame 103 having a frame slot 105 that cooperates with the bag opening 102 to create the ballot slot through which ballots (not shown) are inserted. A closure 107 cooperates with frame 103, and includes a flange 203 (FIG. 2) that when engaged blocks and closes the frame slot 105 and by extension the ballot slot, as further described below, thereby making the ballot slot impassable. The closure 107 includes a recess 109 through which a seal 111 secures the closure 107 to the frame 103.

Turning to FIG. 2, the frame 103 is preferably made of plastic or metal, and has a number of extensions 201 depending from the frame. The closure 107 includes a flange 203. The flange 203 includes a plurality of slide openings 207 through which corresponding extensions 201 pass. The slide opening 207 is used as guides for the extension 201. The slide openings 207 are functionally of a geometry, for example, oval, that allows the closure 107 to be positioned effective to block and to unblock the frame slot 105 with resulting blocking and unblocking of the ballot slot. The extent of movement of the closure 107 is determined by the relationship between the extensions 201 and the extent of the slide openings 207 in a direction generally orthogonal to the plane of the bag opening 102 or frame slot 105.

The frame 103 and closure 107 combination lies on the surface of the bag 101, which is provided, as described above, with a bag opening 102 corresponding to the frame slot 105. The bag surface 101 is provided with a plurality of receptacle openings 211 geometrically corresponding to or registering with the extensions 201 in the frame 103. The frame 103 includes two rows of extensions 201, a first row proximal to the frame slot 105 and a second row distal to the frame slot 105. During assembly the receptacle openings 211 can be formed by the extensions 201 punching through the surface of the bag 101. Alternatively, receptacle openings 211 are pre-punched.

Disposed on the interior surface of the bag 101 is a base frame 213 having a base frame slot 215 corresponding to the frame slot 105 and the bag opening 102, and a series of catch holes 217 registering with the extensions 201. One or more of the catch holes 217 can be, for example, a simple hole or channel that acts as a guide rather than a catch. While the preferred embodiment has been described with respect to integrally formed extensions and catch holes, it should be appreciated that any method for securing the structure, including, for example, staples, rivets, bolts, and the like may be used.

The extensions 201 attached to the frame 103 pass through the openings in the closure 107 and then through the bag receptacle openings 211 and lock within the catch holes 217 in the base frame 213. Because of the elongate geometry of the closure slide openings 207, the closure 107 can be slid towards and away from the frame slot 105 to prevent or to allow access through the ballot slot to the inside of the bag.

Figure 7:
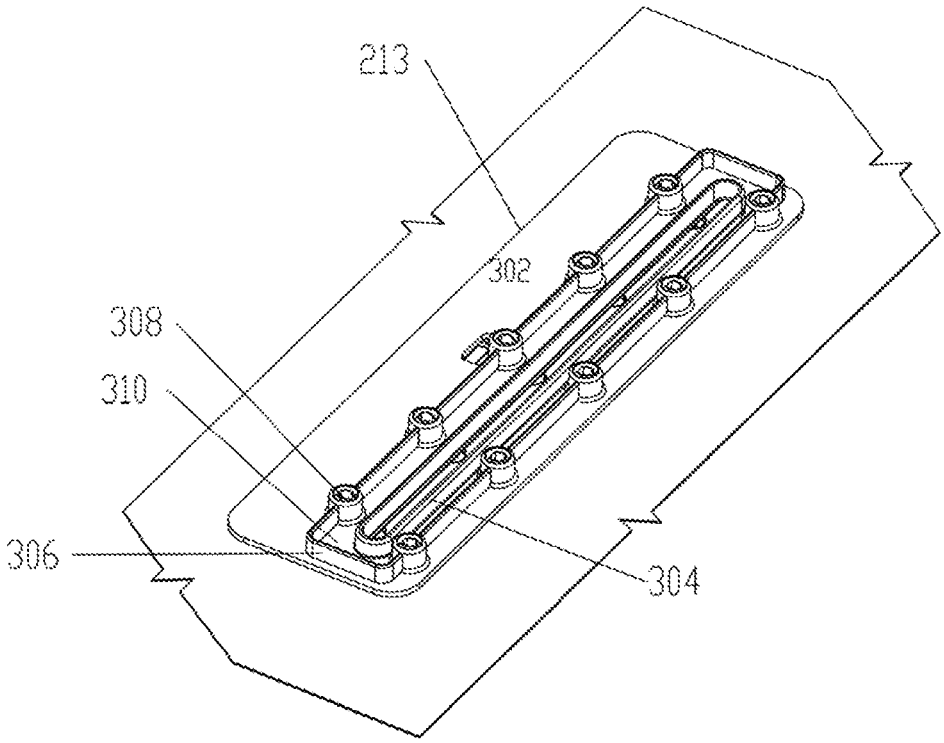
FIG. 7 is a perspective view of an underside of a base frame.
Figure 8:
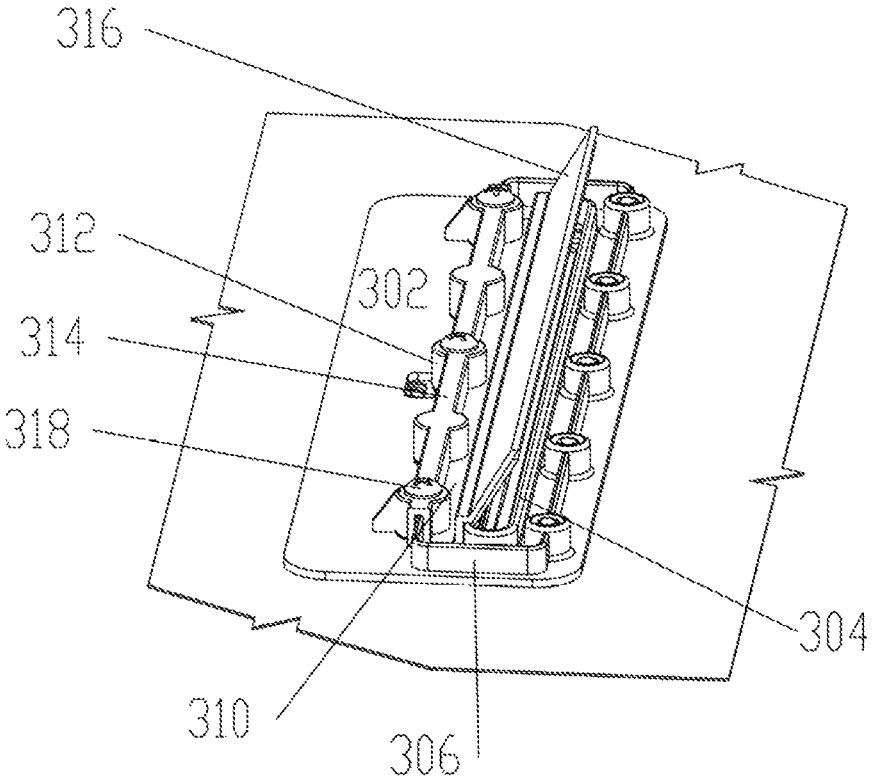
FIG. 8 is a perspective view of an underside of a base frame with a baffle attached.
Figure 9:
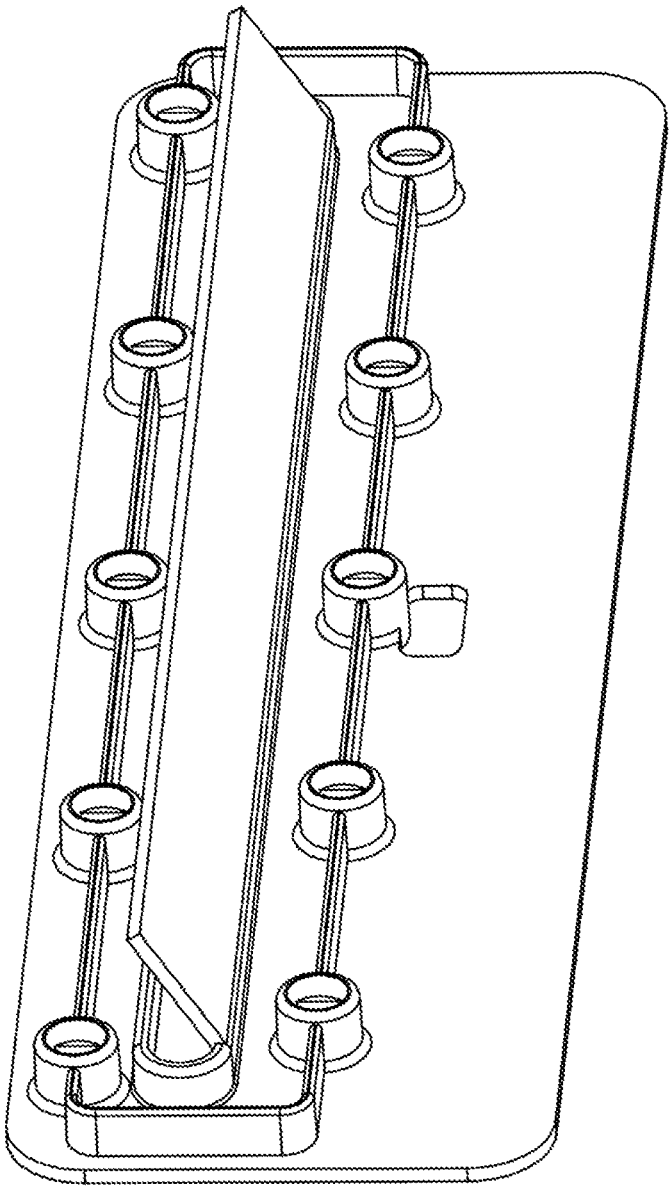
FIG. 9 is a perspective view of a molded base frame/baffle.

Turning now to FIGS. 6-9, a baffle 300 is provided to further insure ballot security when the frame slot 105 is in an open position. As depicted in FIG. 7, the underside 302 of the base frame 213 comprises a slot guide 304 which extends from the base frame underside 302 and runs the circumference of the base frame slot 215 (FIG. 2). Surrounding the slot guide 304 is a base frame guide 306 which also extends from the base frame underside 302 and further comprises a baffle attachment point 308, for example, a threaded receptacle. A trough 310 is formed between the slot guide 304 and the base frame guide 306.

The baffle 300 (FIG. 6) comprises a base frame engaging member 312, a stabilizing member 314, and a slot obstructing member 316.

In a preferred form, the stabilizing member 314 is supported by at least one of the slot guide 304, the base frame guide 306, or the trough 310, preferably supported by two of the three, and most preferably supported by all three.

In one form, the base frame engaging member 312 comprises a fastener 318 retentively engaging the baffle attachment point 308. Alternatively, rather than a fastener, the base frame engaging member 312 and baffle attachment point 308 may utilize snap fit geometry.

The stabilizing member 312 comprises a base frame guide engagement portion 320 having a base frame guide surrounding geometry, for example, an inverted square U geometry; a trough engaging portion 322 which includes a shoulder 324 which rests upon slot guide 304, and an angled slot obstructing member 316. Angle $\alpha$ formed by the shoulder 324 and the slot obstructing member 316 is an obtuse angle, preferably about 170 degrees to about 105 degrees, most preferably about 120 degrees. In this manner an inserted ballot is deflected into the receptacle and there is no unobstructed path of withdrawal.

In this manner, ballots inserted through the ballot slot are deflected by the slot obstructing member 316. This geometry prevents a pathway to shake out a ballot once inserted and also provides a barrier to reaching from outside to inside the bag to obtain its contents.

To seal the ballot slot the closure 107 is moved towards the frame slot opening 105 to form the arrangement depicted in FIG. 1B, whereby the flange 203 (FIG. 2) closes the frame slot opening 105 and by extension the ballot slot. The frame 103 preferably has finger depressions 218 to facilitate opening the closure 107. Complete removal of the closure 107 is prevented because the closure 107 is locked to the ballot bag 101. A seal 111 (FIGS. 1A, 1B), 219 (FIG. 2) is provided as a monolithic plate having one or more seal extensions 221 (FIG. 2), although any monolithic geometry can be used.

The seal extensions 221 pass through a seal opening 223 provided in the closure 107 and engage a seal catch 225 in the frame 103, thereby locking the closure 107 to the frame 103 and sealing the ballot slot. Being made of plastic or metal, the seal 219 must be broken, destroyed, or deformed in order to release the closure 107 from the frame 103. Being made of metal or plastic, the seals are relatively inexpensive to make, and the plate can be manually broken away from the seal extensions to unlock the closure.

When the ballot slot is the only opening in the bag 101, the bag is not reusable. The bag 101 can be provided with a second locked and tamper evident closure (not shown) to enable the ballots to be removed without damaging the bag, and then relocked so the bag can be reused. Preferably, the seal 219 is tamper evident by having to be deformed, destroyed, or otherwise generally compromised to unseal. When used with a ballot box, the box can be provided with a locked door to allow removal of the ballots and reuse of the box.

To further deter tampering the plate portion of the seal 219 preferably has permanent indicia placed thereon, such as by printing, imprinting, or embossing, or has permanently adhered on its surface a tamper evident film, for example, a holographic film. The indicia may also be, for example, coloring or color coding of the seal material. By making the indicia unique and optionally recording the seal and a bag identification even greater security can be achieved. For example, unique numbers may be used.

Although the present invention has been described in connection with specific examples and embodiments, those skilled in the art will recognize that the present invention is capable of other variations and modifications within its scope. For example, the baffle may be fabricated into the mold so it is part of one of the main component pieces, for example, a molded base frame/baffle, depicted in FIG. 9.

These examples and embodiments are intended as typical of, rather than in any way limiting on, the scope of the present invention as presented in the appended claims.

What is claimed is:

1. A ballot receiving device comprising:

a receptacle having a surface defining an inside and an outside and having an opening of a predetermined geometry;

a base disposed inside the receptacle, having an opening corresponding to the geometry of the predetermined opening in the receptacle; a slot guide extending from a base underside and running the circumference of the base opening; a base guide extending from the base underside and surrounding the slot guide comprising a baffle attachment point; and a trough formed between the slot guide and the base guide;

a frame disposed outside the receptacle, having an opening corresponding to the geometry of the predetermined opening in the receptacle, having at least one depending arm, and having a seal catch;

a closure having a flange adapted for blocking at least one of the openings, the flange having a plurality of slide openings, the flange attached to a face having a recess with a seal opening allowing communication with the seal catch; and a baffle extending over the base opening comprising a base engaging member, a stabilizing member, and a slot obstructing member;

wherein the openings register so that a ballot inserted into the opening in the frame passes through the opening in the receptacle surface and the opening in the base to enter the inside of the receptacle;

at least one of the arms passes through at least one of the slide holes for slidable engagement between the closure and the frame in a direction generally orthogonal to the plane of the openings; and the stabilizing member is supported by at least one of the slot guide, the base guide, and the trough.

2. The ballot receiving device of claim 1 wherein the stabilizing member is supported by at least two of the slot guide, the base guide, and the trough.

3. The ballot receiving device of claim 1 wherein the stabilizing member is supported by the slot guide, the base guide, and the trough.

4. The ballot receiving device of claim 1 wherein the stabilizing member comprises a base guide engagement portion having a base guide surrounding geometry, a trough engaging portion, and wherein the slot obstructing member is angled.

5. The ballot receiving device of claim 4 wherein the base guide surrounding geometry is an inverted square U geometry.

6. The ballot receiving device of claim 4 wherein the trough engaging portion comprises a shoulder which rests upon the slot guide, and an obtuse angle is formed by the shoulder and the angled slot obstructing member.

7. The ballot receiving device of claim 6 wherein the obtuse angle is about 170 degrees to about 105 degrees.

8. The ballot receiving device of claim 6 wherein the obtuse angle is about 120 degrees.

9. The ballot receiving device of claim 1 wherein the base engaging member comprises a fastener retentively engaging the baffle attachment point.

10. The ballot receiving device of claim 1 wherein the base engaging member comprises a snap fit geometry retentively engaging the baffle attachment point.

11. A ballot receiving device comprising:

a receptacle having a surface defining an inside and an outside and having an opening of a predetermined geometry;

a base disposed inside the receptacle, having an opening corresponding to the geometry of the predetermined opening in the receptacle; a slot guide extending from a base underside and running the circumference of the base opening; and a base guide extending from the base underside and surrounding the slot guide;

a frame disposed outside the receptacle, having an opening corresponding to the geometry of the predetermined opening in the receptacle, having at least one depending arm, and having a seal catch;

a closure having a flange adapted for blocking at least one of the openings, the flange having a plurality of slide openings, the flange attached to a face having a recess with a seal opening allowing communication with the seal catch; and a baffle extending over the base opening comprising an angled slot obstructing member;

wherein the openings register so that a ballot inserted into the opening in the frame passes through the opening in the receptacle surface and the opening in the base to enter the inside of the receptacle;

at least one of the arms passes through at least one of the slide holes for slidable engagement between the closure and the frame in a direction generally orthogonal to the plane of the openings; and an obtuse angle is formed by the base and the angled slot obstructing member.

12. The ballot receiving device of claim 11 wherein the obtuse angle is about 170 degrees to about 105 degrees.

13. The ballot receiving device of claim 11 wherein the obtuse angle is about 120 degrees.

14. A ballot collecting kit comprising a receptacle having a surface defining an inside and an outside and having an opening of a predetermined geometry;

a base disposed inside the receptacle, having an opening corresponding to the geometry of the predetermined opening in the receptacle; a slot guide extending from a base underside and running the circumference of the base opening; a base guide extending from the base underside and surrounding the slot guide having a baffle attachment point; and a trough formed between the slot guide and the base guide;

a frame disposed outside the receptacle, having an opening corresponding to the geometry of the predetermined opening in the receptacle, having at least one depending arm, and having a seal catch;

a closure having a flange adapted for blocking at least one of the openings, the flange having a plurality of slide openings, the flange attached to a face having a recess with a seal opening allowing communication with the seal catch;

a baffle extending over the base opening comprising a base engaging member, a stabilizing member, and a slot obstructing member; and a plurality of seals locking the closure to the frame, the seal passing through a seal opening in the closure and engaging the seal catch in the frame, and the flange obstructing the openings when the device is in a secured condition;

wherein the openings register so that a ballot inserted into the opening in the frame passes through the opening in the receptacle surface and the opening in the base to enter the inside of the receptacle;

at least one of the arms passes through at least one of the slide holes for slidable engagement between the closure and the frame in a direction generally orthogonal to the plane of the openings; and the stabilizing member is supported by at least one of the slot guide, the base guide, and the trough.

15. The ballot collecting kit of claim 14 wherein the stabilizing member is supported by at least two of the slot guide, the base guide, and the trough.

16. The ballot collecting kit of claim 14 wherein the stabilizing member is supported by the slot guide, the base guide, and the trough.

17. The ballot collecting kit of claim 14 wherein the stabilizing member comprises a base guide engagement portion having a base guide surrounding geometry, a trough engaging portion, and wherein the slot obstructing member is angled.

18. The ballot collecting kit of claim 17 wherein the trough engaging portion comprises a shoulder which rests upon the slot guide, and an obtuse angle is formed by the shoulder and the angled slot obstructing member.

19. The ballot collecting kit of claim 18 wherein the obtuse angle is about 170 degrees to about 105 degrees.

20. The ballot collecting kit of claim 18 wherein the obtuse angle is about 120 degrees.

* * * * *